United States Patent [19]

Hebeisen et al.

[11] 4,140,528

[45] Feb. 20, 1979

[54] NICKEL-BASE SUPERALLOY COMPACTED ARTICLES

[75] Inventors: John C. Hebeisen, Mt. Lebanon; Vernon R. Thompson, Pittsburgh, both of Pa.

[73] Assignee: Crucible Inc., Pittsburgh, Pa.

[21] Appl. No.: 784,194

[22] Filed: Apr. 4, 1977

[51] Int. Cl.[2] ..... B22F 3/00; B22F 1/00

[52] U.S. Cl. ..... 75/246; 75/0.5 C; 75/211; 148/11.5 P; 148/11.5 H

[58] Field of Search ..... 148/11.5 P, 11.5 H; 75/0.5 BA, 0.5 C, 211, 246

[56] References Cited

U.S. PATENT DOCUMENTS

| | | | |
|---|---|---|---|
| 3,681,061 | 8/1972 | Flecher | 75/243 |
| 3,726,722 | 4/1973 | Foerster | 148/11.5 P |

FOREIGN PATENT DOCUMENTS

| | | | |
|---|---|---|---|
| 572148 | 3/1959 | Canada | 75/0.5 C |

*Primary Examiner*—Brooks H. Hunt

[57] ABSTRACT

A nickel-base superalloy compacted fully dense article, produced by a powder metallurgy technique from prealloyed powder, said article being characterized by the absence of thermal induced porosity when heated at temperatures of at least 2200° F., and exhibiting improved superplastic behavior during forming operations, such as forging.

9 Claims, 4 Drawing Figures

200X

200X

200X

200X

NICKEL-BASE SUPERALLOY COMPACTED ARTICLES

Nickel-base superalloys are conventionally used as constructional materials for high-temperature service applications, such as components for jet engines. These components are subject during service to high operating temperatures. In many applications these components must exhibit high strength and hardness at elevated temperatures. Also, the article must be readily formable, as by hot-working techniques, such as forging, to the final product shapes. Likewise, the article must be resistant to cracking during service, which requires that the interior be free from voids and porosity.

Articles of this type have been made by vacuum melting material which is solidified in ingot form and hot worked by rolling and/or forging to the desired product configuration, which working operation generally involved a multiplicity of steps. After working, the product is heat treated by solution annealing and age hardening. In these heat treatments the strength and ductility characteristics are controlled both by the extent of deformation and the temperature employed during working and subsequent heat treatment. More recently, however, in an attempt to achieve an improved product from the standpoint of economies in fabrication and improved microstructure it has been the practice to produce articles of this type by powder metallurgy techniques. Typically, these techniques include the steps of producing a prealloyed nickel-base superalloy powder by inert gas atomization of a molten metal mass thereof. Gases suitable for this purpose have been argon and helium. After solidification the particles are containerized, heated to elevated temperature and hot compacted by techniques such as hot pressing, sintering or hot isostatic compacting. Subsequent to these operations the compacted fully dense article is subject to the typical elevated-temperature heat treatments and forming operations incident to producing the desired final products.

Although compacted articles of this type have exhibited great advantage from the mechanical-property standpoint and economies of fabrication, a disadvantage of the practice is that during high temperature heat treatment the articles are susceptible to thermally induced porosity, which is characterized by the formation of gas bubbles or voids during heat treatment at temperatures of 1800° or 1900° F. and above. Articles having thermally induced porosity have been found to contain concentrations of the inert gas used in the atomization production of the prealloyed powder particles. This effect has been discovered with both argon and helium gas, which are those inert gases typically used for the purpose. Attempts to remove these gases prior to consolidation by various hot vacuum treatments and flushing cycles have been largely unsuccessful.

It is accordingly a primary object of this present invention to produce a nickel-base superalloy compacted article of substantially full density that is not characterized by thermal induced porosity and is made from compacted, atomized prealloyed particles.

An additional object of the invention is to provide an article of the type that exhibits improved superplastic behavior during forming operations.

These and other objects of the invention as well as a more complete understanding thereof may be obtained from the following description specific examples and drawings, in which.

Figure 1:
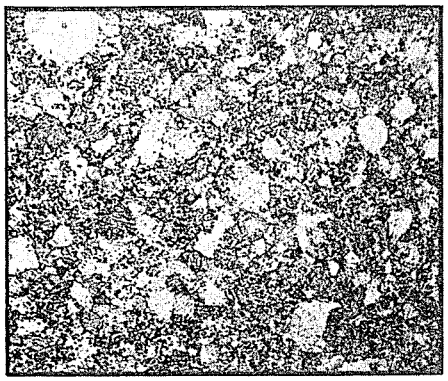
FIG. 1 is a photomicrograph of a specific nickel-base superalloy compacted article made by the compacting of argon atomized particles.

Broadly, the invention is that superalloy powders which are prepared by atomization of nickel-base superalloys to produce prealloyed powder by nitrogen gas atomization provide distinct advantage over identical powders prepared by inert gas atomization, such as by the use of argon and helium, when compacted to fully dense articles. First, these powders when consolidated to fully dense articles are not susceptible to thermally induced porosity. In other words, the microstructure is not characterized by voids identified as gas pores resulting from the particular gas used during the atomization production of the prealloyed powder. Second, the nitrogen atomized powders when consolidated to fully dense articles, relative to articles made by the use of inert gas atomized powders of the same composition, show equivalent tensile and stress rupture properties while showing a drastic improvement in superplastic behavior; in other words the articles of the invention are more readily formable than articles made by the use of inert-gas-atomized prealloyed powders.

As a specific example of the invention a modified IN-100 prealloyed nickel-base powders were prepared by nitrogen and argon atomization using otherwise identical techniques. Compositions of these two powders are shown in Table I.

TABLE I

COMPOSITION OF MODIFIED IN-100 POWDERS

| Element | Content (Wt. %) Ar Atomized | $N_2$ Atomized |
|---|---|---|
| C | .073 | .054 |
| Mn | .01 | .01 |
| Si | .13 | .17 |
| Cr | 12.20 | 12.32 |
| Co | 17.94 | 17.73 |
| Mo | 3.29 | 3.25 |
| B | .036 | .037 |
| Zr | .04 | .06 |
| Fe | .09 | .04 |
| Ti | 4.37 | 4.43 |
| Al | 5.10 | 4.85 |
| V | .83 | .76 |
| $O_2$ | .0070 | .0060 |
| $N_2$ | .0070 | .0406 |
| Ni | Bal. | Bal. |

Each powder type as set forth in Table I was screened to −80 mesh, blended and loaded into vacuum-tight mild steel containers. The powders were cleaned by outgassing which involved heating to 500° F. under a dynamic vacuum and the containers were sealed against the atmosphere by pressure welding. Each powder filled container was then compacted by extrusion at a temperature of 1900° F. (an extrusion ratio of 10.5:1) and by hot isostatic compacting at 1900° F. at a pressure of 15,000 psi. Essentially full density was achieved in each instance. The results of these specific experiments from the standpoint of thermally induced porosity are shown in the FIGURES of the drawing. With respect to FIGS. 1 and 1A upon heating to 2275° F. extensive gas porosity was generated in the argon atomized compact as may be seen from these FIGURES. In contrast as may be noted from FIGS. 2 and 2A no density change resulted during the identical heat treatment of the compact made from the nitrogen atomized prealloyed powder.

The results of superplasticity testing of the compacts made from the nitrogen and argon atomized powders are presented in Table II.

TABLE II

SUPERPLASTIC BEHAVIOR OF MODIFIED IN-100

| Atomizing Gas | Consolidation Technique | Consolidation Temp. (° F) | Test Temp. (° F) | Test Strain Rate ($Min^{-1}$) | Tensile Strength (ksi) | Elongation (%) | Reduction of Area (%) |
|---|---|---|---|---|---|---|---|
| Argon | Extrusion | 1900 | 1975 | .78 | 7.4 | 530 | 98 |
| Argon | Extrusion | 1900 | 1975 | .76 | 10.5 | 556 | 97 |
| Nitrogen | Extrusion | 1900 | 1975 | .76 | 7.8 | 1170 | 99 |
| Nitrogen | Extrusion | 1900 | 1975 | .75 | 6.4 | 1026 | 97 |
| Argon | HIP* | 1900 | 1975 | .70 | 25.0 | 12 | 14 |
| Argon | HIP* | 1900 | 1975 | .06 | 12.0 | 35 | 27 |
| Nitrogen | HIP* | 1900 | 1975 | .70 | 21.0 | 6 | 7 |
| Nitrogen | HIP* | 1900 | 1975 | .06 | 9.0 | 360 | 87 |

*HIP=Hot isostatically pressed

The improvement at similar strain rates may be noted for the material made from the nitrogen atomized powders.

TABLE III

TENSILE PROPERTIES OF MODIFIED IN-100*

| Atomizing Gas | Consolidation Technique | Consolidation Temp. (° F) | Test Temp. (° F) | .2% Yield Strength (ksi) | Tensile Strength (ksi) | Elongation (%) | Reduction of Area (%) |
|---|---|---|---|---|---|---|---|
| Argon | Extrusion | 1900 | RT | 160 | 227 | 26 | 26 |
| Nitrogen | Extrusion | 1900 | RT | 164 | 228 | 24 | 28 |
| Argon | Extrusion | 1900 | 1300 | 149 | 174 | 23 | 25 |
| Nitrogen | Extrusion | 1900 | 1300 | 150 | 170 | 24 | 27 |
| Argon | HIP** | 1900 | RT | 151 | 205 | 13 | 19 |
| Nitrogen | HIP** | 1900 | RT | 151 | 215 | 20 | 22 |
| Argon | HIP** | 1900 | 1300 | 145 | 176 | 13 | 17 |
| Nitrogen | HIP** | 1900 | 1300 | — | 177 | 9 | 12 |

*Heat Treatment: 2075° F/4 hr./OQ + 1600° F/8 hr./AC + 1800° F/4 hr./AC + 1200° F/24 hr./AC + 1400° F/8 hr./AC.
**HIP=Hot isostatically pressed.

As may be seen from the tensile properties of the compacts presented in Table III, essentially no difference was observed between the behavior of the argon and nitrogen atomized powders used in the production of the respective compacts.

As a second specific example of the invention Rene 95 powders were prepared by nitrogen and argon atomization. The chemical analyses of the powder heats are given in Table IV. Both powders were screened to −60 mesh, loaded into mild steel cans, evacuated at 500° F. and sealed. The powders were then compacted to full density by hot isostatic compaction at 2050° F. and 15,000 psi.

Figure 1A:
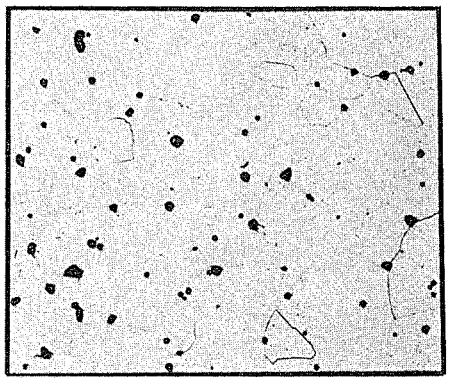
FIG. 1A is a photomicrograph of the article of FIG. 1 after heat treating at 2275° F. for four hours.
Figure 2:
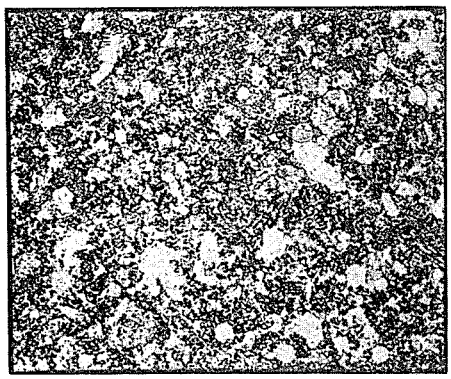
FIG. 2 is a photomicrograph of an article similar to that of FIG. 1 except that it is produced from nitrogen atomized powder.
Figure 2A:
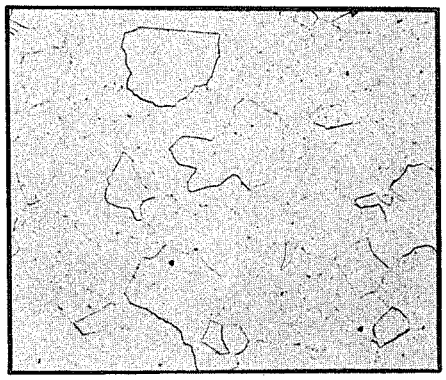
FIG. 2A is a photomicrograph of the article of FIG. 2 after heat treating at 2275° F. for four hours and air cooling.

The density changes in these products after compaction to full density were essentially as depicted in FIGS. 1 and 2. After heating to 2200° F. for four hours and air cooling, the argon atomized Rene 95 product developed extensive porosity essentially similar to that shown in FIG. 1A, while the nitrogen atomized product remained at full density.

Table V shows the tensile and stress rupture properties of the two materials in the heat treated condition. Essentially no difference is observed.

TABLE IV

COMPOSITION OF RENE 95 POWDERS

| Element | Content (Wt. %) Ar Atomized | Content (Wt. %) $N_2$ Atomized |
|---|---|---|
| C | .054 | .022 |
| N | .002 | .043 |
| Cr | 12.99 | 13.10 |
| Co | 8.15 | 8.23 |
| Mo | 3.49 | 3.48 |
| W | 3.46 | 3.37 |
| Cb | 3.60 | 3.51 |
| Al | 3.47 | 3.42 |
| Ti | 2.53 | 2.60 |
| Zr | .05 | .04 |
| B | .009 | .008 |
| $O_2$ | .0067 | .0035 |
| Si | .07 | .07 |
| S | .005 | .005 |
| P | — | <.003 |
| Fe | .10 | .05 |
| Mn | <.01 | <.01 |
| Ni | Bal. | Bal. |

TABLE V

TENSILE PROPERTIES OF RENE 95*

| Atomization Gas | Test Temp. ° F | Tensile .2% Yield Strength (ksi) | Tensile Ultimate Strength (ksi) | Tensile Elongation (%) | Tensile Reduction of Area (%) | 1200° F/150 ksi Stress Rupture Life (hrs.) | 1200° F/150 ksi Stress Rupture Elongation (%) | 1200° F/150 ksi Stress Rupture Reduction of Area (%) |
|---|---|---|---|---|---|---|---|---|
| Argon | RT | 178. | 229 | 12 | 16 | | | |
| | 1200 | 168 | 220 | 14 | 16 | 29 | 2 | 3 |
| Nitrogen | RT | 180 | 237 | 17 | 18 | | | |

TABLE V-continued

| TENSILE PROPERTIES OF RENE 95* | | | | | | | | |
|---|---|---|---|---|---|---|---|---|
| | | Tensile | | | | 1200° F/150 ksi Stress Rupture | | |
| Atomization Gas | Test Temp. ° F | .2% Yield Strength (ksi) | Ultimate Strength (ksi) | Elongation (%) | Reduction of Area (%) | Life (hrs.) | Elongation (%) | Reduction of Area (%) |
| | 1200 | 163 | 219 | 14 | 16 | 124 | 4 | 6 |

*1650° F/4 hrs.—2100° F/1 hr./fan air cool + 1600° F/1 hr./AC + 1200° F/24 hrs./AC.

Although the invention would appear to have application broadly with respect to nickel-base superalloy articles of any of the known superalloy compositions, Table VI will, for the sake of completeness of disclosure, provide an example of the metallurgical composition limits of alloys to which the invention provides particular benefit.

TABLE VI

COMPOSITIONS OF TYPICAL NICKEL-BASE SUPERALLOYS TO WHICH SUBJECT INVENTION IS DIRECTED

| Alloy Designation | Chemical Composition, Weight % | | | | | | | | | | | | | | | | | |
|---|---|---|---|---|---|---|---|---|---|---|---|---|---|---|---|---|---|---|
| | C | Mn | Si | Cr | Ni | Co | Mo | W | Cb | Fe | Ti | Al | B | Zr | V | Ta | Hf | Cb+Ta |
| IN-100 | .05/.09 | <.02 | <.10 | 11.9/12.9 | Bal. | 18.0/19.0 | 2.8/3.6 | <.05 | — | <.30 | 4.15/4.50 | 4.80/5.15 | .016/.024 | .04/.08 | .58/.98 | — | — | <.04 |
| RENE 95 | .04/.09 | <.15 | <.20 | 12.0/14.0 | Bal. | 7.0/9.0 | 3.3/3.7 | 3.3/3.7 | 3.3/3.7 | <.50 | 2.3/2.7 | 3.3/3.7 | .006/.015 | .03/.07 | — | <.20 | — | — |
| ASTROLOY | .03/.09 | <.15 | <.20 | 14.0/16.0 | Bal. | 16.0/18.0 | 4.5/5.5 | — | — | <.50 | 3.35/3.65 | 3.85/4.15 | .020/.030 | <.06 | — | — | — | — |
| WASPALOY | .03/.10 | <.75 | <.75 | 18.0/21.0 | Bal. | 12.0/15.0 | 3.5/5.0 | — | — | <2.0 | 2.75/3.25 | 1.20/1.60 | .003/.010 | .02/.12 | — | — | — | — |
| PA 101 | .02/.16 | <.10 | <.10 | 12.2/13.0 | Bal. | 8.5/9.5 | — | 3.85/4.05 | — | <.50 | 3.9/4.2 | 3.2/3.6 | .01/.02 | .08/.14 | — | 3.85/4.05 | 0.75/1.25 | — |
| IN-718 | .02/.08 | <.35 | <.35 | 17.0/21.0 | Bal. | <1.0 | 2.8/3.3 | — | — | 15.0/21.0 | 0.75/1.15 | .30/.70 | <.006 | — | — | — | — | 4.75/5.50 |
| AF 115 | .03/.07 | <.15 | <.20 | 9.95/11.45 | Bal. | 14.5/15.5 | 2.6/3.0 | 5.6/6.2 | 1.5/1.9 | <1.0 | 3.6/4.2 | 3.5/4.1 | .015/.025 | .03/.07 | — | — | 1.7/2.3 | — |
| AF 21 DA | .30/.35 | <.10 | <.10 | 11.5/12.5 | Bal. | 9.5/10.5 | 2.5/3.5 | 5.5/6.5 | — | <.5 | 2.75/3.25 | 4.2/4.8 | .01/.02 | .05/.15 | — | 1.0/2.0 | — | — |

The difference with respect to thermal induced porosity with respect to the compacts made from nitrogen atomized powders as opposed to inert gas atomized powders is believed to result from the fact that the inert gas becomes entrapped in the compact during the hot compacting operation. In contrast, however, with nitrogen gas as the atomizing medium, the nitrogen entrapped in the compact reacts chemically with the alloy, as by the formation of nitrides of the various alloying elements such as boron, and thus permits compacting to a substantially void-free cross-section. The superplastic behavior of the compacts made from nitrogen atomized particles is believed to result from the finer grain size typically seen in these materials.

We claim:

1. A nickel-base superalloy compacted fully dense article produced by a method including atomizing a molten metal mass of the desired superalloy composition by use of nitrogen gas to form prealloyed particles thereof, heating said particles to elevated compacting temperature, and compacting said particles at elevated temperature to essentially full density to form a compact, said article being characterized by an absence of thermally induced porosity when subsequently heated to a temperature of 1800° F. and above.

2. The article of claim 1 wherein the superalloy composition thereof consists essentially of, in weight percent:

| Element | Weight, % |
|---|---|
| Carbon | .05 to .09 |
| Manganese | <.02 |
| Silicon | <.10 |
| Chromium | 11.9 to 12.9 |
| Cobalt | 18.0 to 19.0 |
| Molybdenum | 2.8 to 3.6 |
| Tungsten | <.05 |
| Iron | <.30 |
| Titanium | 4.15 to 4.50 |
| Aluminum | 4.80 to 5.15 |
| Boron | .016 to .024 |
| Zirconium | .04 to .08 |
| Vanadium | .58 to .98 |
| Columbium + Tantalum | <.04 |
| Nickel | Balance |

3. The article of claim 1 wherein the superalloy composition thereof consists essentially of, in weight percent:

| Element | Weight, % |
|---|---|
| Carbon | .04 to .09 |
| Manganese | <.15 |
| Silicon | <.20 |
| Chromium | 12.0 to 14.0 |
| Cobalt | 7.0 to 9.0 |
| Molybdenum | 3.3 to 3.7 |
| Tungsten | 3.3 to 3.7 |
| Columbium | 3.3 to 3.7 |
| Iron | <.50 |
| Titanium | 2.3 to 2.7 |
| Aluminum | 3.3 to 3.7 |
| Boron | .006 to .015 |
| Zirconium | .03 to .07 |
| Tantalum | <.20 |

-continued

| Element | Weight, % |
|---|---|
| Nickel | Balance |

4. The article of claim 1 wherein the superalloy composition thereof consists essentially of, in weight percent:

| Element | Weight, % |
|---|---|
| Carbon | .03 to .09 |
| Manganese | <.15 |
| Silicon | <.20 |
| Chromium | 14.0 to 16.0 |
| Cobalt | 16.0 to 18.0 |
| Molybdenum | 4.5 to 5.5 |
| Iron | <.50 |
| Titanium | 3.35 to 3.65 |
| Aluminum | 3.85 to 4.15 |
| Boron | .020 to .030 |
| Zirconium | <.06 |
| Nickel | Balance |

5. The article of claim 1 wherein the superalloy composition thereof consists essentially of, in weight percent:

| Element | Weight, % |
|---|---|
| Carbon | .03 to .10 |
| Manganese | <.75 |
| Silicon | <.75 |
| Chromium | 18.0 to 21.0 |
| Cobalt | 12.0 to 15.0 |
| Molybdenum | 3.5 to 5.0 |
| Iron | <2.0 |
| Titanium | 2.75 to 3.25 |
| Aluminum | 1.20 to 1.60 |
| Boron | .003 to .010 |
| Zirconium | .02 to .12 |
| Nickel | Balance |

6. The article of claim 1 wherein the superalloy composition thereof consists essentially of, in weight percent:

| Element | Weight, % |
|---|---|
| Carbon | .02 to .16 |
| Manganese | <.10 |
| Silicon | <.10 |
| Chromium | 12.2 to 13.0 |
| Cobalt | 8.5 to 9.5 |
| Tungsten | 3.85 to 4.05 |
| Iron | <.50 |
| Titanium | 3.9 to 4.2 |
| Aluminum | 3.2 to 3.6 |
| Boron | .01 to .02 |
| Zirconium | .08 to .14 |
| Tantalum | 3.85 to 4.05 |
| Hafnium | 0.75 to 1.25 |

-continued

| Element | Weight, % |
|---|---|
| Nickel | Balance |

7. The article of claim 1 wherein the superalloy composition thereof consists essentially of, in weight percent:

| Element | Weight, % |
|---|---|
| Carbon | .02 to .08 |
| Manganese | <.35 |
| Silicon | <.35 |
| Chromium | 17.0 to 21.0 |
| Cobalt | <1.0 |
| Molybdenum | 2.8 to 3.3 |
| Iron | 15.0 to 21.0 |
| Titanium | 0.75 to 1.15 |
| Aluminum | .30 to .70 |
| Boron | <.006 |
| Columbium + Tantalum | 4.75 to 5.50 |
| Nickel | Balance |

8. The article of claim 1 wherein the superalloy composition thereof consists essentially of, in weight percent:

| Element | Weight, % |
|---|---|
| Carbon | .03 to .07 |
| Manganese | <.15 |
| Silicon | <.20 |
| Chromium | 9.95 to 11.45 |
| Cobalt | 14.5 to 15.5 |
| Molybdenum | 2.6 to 3.0 |
| Tungsten | 5.6 to 6.2 |
| Columbium | 1.5 to 1.9 |
| Iron | <1.0 |
| Titanium | 3.6 to 4.2 |
| Aluminum | 3.5 to 4.1 |
| Boron | .015 to .025 |
| Zirconium | .03 to .07 |
| Hafnium | 1.7 to 2.3 |
| Nickel | Balance |

9. The article of claim 1 wherein the superalloy composition thereof consists essentially of, in weight percent:

| Element | Weight, % |
|---|---|
| Carbon | .30 to .35 |
| Manganese | <.10 |
| Silicon | <.10 |
| Chromium | 11.5 to 12.5 |
| Cobalt | 9.5 to 10.5 |
| Molybdenum | 2.5 to 3.5 |
| Tungsten | 5.5 to 6.5 |
| Iron | <.5 |
| Titanium | 2.75 to 3.25 |
| Aluminum | 4.2 to 4.8 |
| Boron | .01 to .02 |
| Zirconium | .05 to .15 |
| Tantalum | 1.0 to 2.0 |
| Nickel | Balance |

* * * * *